US007743516B2

(12) United States Patent
Gross

(10) Patent No.: US 7,743,516 B2
(45) Date of Patent: Jun. 29, 2010

(54) TRIM INSTALLATION TOOL

(76) Inventor: Michael F. Gross, 106 Salzburg, Bay City, MI (US) 48706

( * ) Notice: Subject to any disclaimer, the term of this patent is extended or adjusted under 35 U.S.C. 154(b) by 82 days.

(21) Appl. No.: 12/143,957

(22) Filed: Jun. 23, 2008

(65) Prior Publication Data

US 2009/0313838 A1 Dec. 24, 2009

(51) Int. Cl.
*G01B 5/14* (2006.01)
*E04F 21/00* (2006.01)

(52) U.S. Cl. ..... 33/194

(58) Field of Classification Search ..... 33/194, 33/562

See application file for complete search history.

(56) References Cited

U.S. PATENT DOCUMENTS

| | | | | | |
|---|---|---|---|---|---|
| 880,252 | A * | 2/1908 | Tennent | 33/194 |
| 2,473,639 | A * | 6/1949 | Erickson | 33/42 |
| 2,973,584 | A * | 3/1961 | Snapp | 33/194 |
| D310,972 | S | 10/1990 | Neuman | |
| 4,989,336 | A | 2/1991 | Waltrip, Jr. et al. | |
| 5,123,172 | A | 6/1992 | Thrun | |
| 5,179,787 | A * | 1/1993 | Ostrowski | 33/613 |
| 5,737,844 | A * | 4/1998 | Brumley | 33/194 |
| 5,775,036 | A * | 7/1998 | Stanley, Sr. | 52/127.2 |
| 6,101,730 | A * | 8/2000 | Marino | 33/526 |
| 6,341,427 | B1 * | 1/2002 | Tepley | 33/194 |
| 6,442,853 | B1 * | 9/2002 | Hale et al. | 33/194 |
| 6,532,674 | B2 | 3/2003 | Farese | |
| 6,839,977 | B1 * | 1/2005 | Truckner | 33/562 |
| 7,210,676 | B1 * | 5/2007 | Blau | 269/37 |
| 7,240,435 | B1 | 7/2007 | Dowdakin | |
| 7,509,746 | B1 * | 3/2009 | Kozina et al. | 33/194 |
| 2003/0131486 | A1 | 7/2003 | Wallace | |
| 2008/0083130 | A1 * | 4/2008 | Parkes et al. | 33/562 |

* cited by examiner

*Primary Examiner*—Christopher W Fulton
(74) *Attorney, Agent, or Firm*—Frederick W. Mau, II

(57) ABSTRACT

A trim installation tool, attachable to the jamb of a window or door, which aids in the installation of trim. The tool provides for the marking of a consistent reveal around a door or window when installing trim. The tool also provides a surface which may be used to provide support to the end of a tape measure when performing measurements. Additionally, the tool may provide support for the trim being installed around the door or window.

19 Claims, 9 Drawing Sheets

TRIM INSTALLATION TOOL

FIELD OF THE INVENTION

The present invention generally relates to a tool to aid when installing trim around doors and windows. More particularly, the present invention relates to a tool which aids in marking a consistent reveal when installing trim around doors and windows.

BACKGROUND

Finish carpentry is a necessary aspect of most carpentry projects. Finish carpentry includes installing trim around doors or windows to improve aesthetic appearance. When installing trim around doors and windows, it is important to have consistent reveals around the door or window jambs for appearance purposes. It is also important to ensure proper measurements so all of the trim pieces fit together around the door or window. Furthermore, it is necessary to have proper support of the trim during installation to allow for consistent installation of the trim around the door or window jamb.

The installation of trim, especially in elevated positions, is a difficult task for a person to perform by oneself. It can be very difficult and time consuming to mark consistent reveals around door jambs with a measuring device and straight edge. It is also very difficult to hold a tape measure in place to make critical measurements. Furthermore, the trim pieces can be very difficult to install without help as the trim piece must be held in place to ensure proper installation.

Some tools have been designed to aid in the installation of trim, particularly in the marking of a reveal around the jamb of a window or door. One such tool is disclosed in U.S. Patent Publication No. 2003/0131486 to Wallace. Wallace describes a trim setting gauge which uses a sliding blade to mark a desired margin measurement around the corner of a door jamb. The metal blade is marked in inches and millimeters to provide the necessary measurement. Another tool for aiding in marking the reveal around a jamb is disclosure by Dowdawkin in U.S. Pat. No. 7,240,435. Dowdawkin discloses an adjustable trim gage including an adjustable scribing block which is adjustably attached to a guide block. During use the guide block is positioned adjacent to the jamb and the scribing block is positioned with respect to the guide surface such that a desired reveal may be marked. The tools disclosed by Wallace and Dowdawkin, however, can not be used to support trim during installation or provide a surface from which to take a measurement via a tape measure.

U.S. Pat. No. 5,123,172 to Thrun discloses a spacing gauge for molding and trim. The spacing gauge allows a user to temporarily install the gauge to a frame which allows for marking and installation of the trim by one person. The gauge includes a securing arm, which is attached around the side of the frame to help secure the gauge in place. The gauge, however, may have difficulty attaching to some surfaces, due to the need for the securing arm. Furthermore, temporary installation of the gauge can be time consuming as temporary installation requires fitting the gauge to the frame and securing the a set screw to hold the he gauge in place requires multiple actions to install around a frame.

While tools generally used to mark reveals appear to be known, there is still a need in the art for a finishing tool which allows a single user to install trim and mark consistent reveals in a simple fashion.

SUMMARY OF THE INVENTION

Disclosed herein, is a trim installation tool comprising a support portion having an upper surface and one or more side surfaces, one or more reveal locating ledges disposed proximate to and extending outwardly from the support portion; and one or more attachment pins extending from the upper surface of the support portion. At least one of the one or more side surfaces may be disposed at a 90 degree angle, an acute angle, or an obtuse angle with respect to the upper surface of said support portion. The upper surface of the support portion may comprise two sections which together form an obtuse angle. The upper surface of the support portion may also have an arcuate shape.

At least one of the reveal locating edges may be disposed proximate to and extends outwardly from said upper surface and/or one or more of the side surfaces of the support portion. The one or more reveal locating ledges may form 90 degree notches at one or more edges of the upper surface of the support portion. The one or more reveal locating ledges may be formed from one or more reveal locating members. The reveal locating members may comprise a block disposed adjacent to the support portion. The one or more reveal locating members may be adjustable vertically, horizontally, or diagonally with respect to said support portion. The trim installation may further comprise one or more trim guides disposed adjacent to and extending outwardly from one or more of the reveal locating ledges.

The one or more attachment pins may retract into the support portion of the trim installation tool. The trim installation tool may further comprise a handle in mechanical communication with the one or more attachment pins, the handle causing the one or more attachment pins to extend from and retract into the support portion. The handle may be biased in a downward direction from the support portion by a biasing member.

The trim installation tool may further comprise a first extension member. The first extension member extends outwardly from the upper surface of the support portion. The first extension member has one or more reveal locating ledges disposed proximate to and extending outwardly from the upper surface of the first extension member. The first extension member may be detachable connected to the support portion. The first extension member may be flexible.

The trim installation tool may further comprise a second extension member hingedly connected to the first extension member. The second extension member has one or more reveal locating ledges disposed proximate to and extending outwardly from the upper surface of the second extension member. The hinged connection between the first extension member and the second extension member may be formed by a locking hinge. The trim installation tool may further comprise a second support member attached to the second extension member. The second support member may have an upper surface, one or more side surfaces, and one or more attachment pins extending from the upper surface of the second support portion.

DETAILED DESCRIPTION OF THE PREFERRED EMBODIMENTS OF THE INVENTION

In accordance with the present invention there is provided a trim installation tool which aids in the installation of trim around doors and windows. The tool provides for the marking of a consistent reveal around a door or window when installing trim. The tool also provides a surface which may be used to provide support to the end of a tape measure when performing measurements. Additionally, the tool may provide support for the trim being installed around the door or window. The tool may be attached and detached from the door or window jamb easily with the use of one hand. As such, the tool allows the user to easily install trim around windows or doors without the need for assistance.

Figure 1:
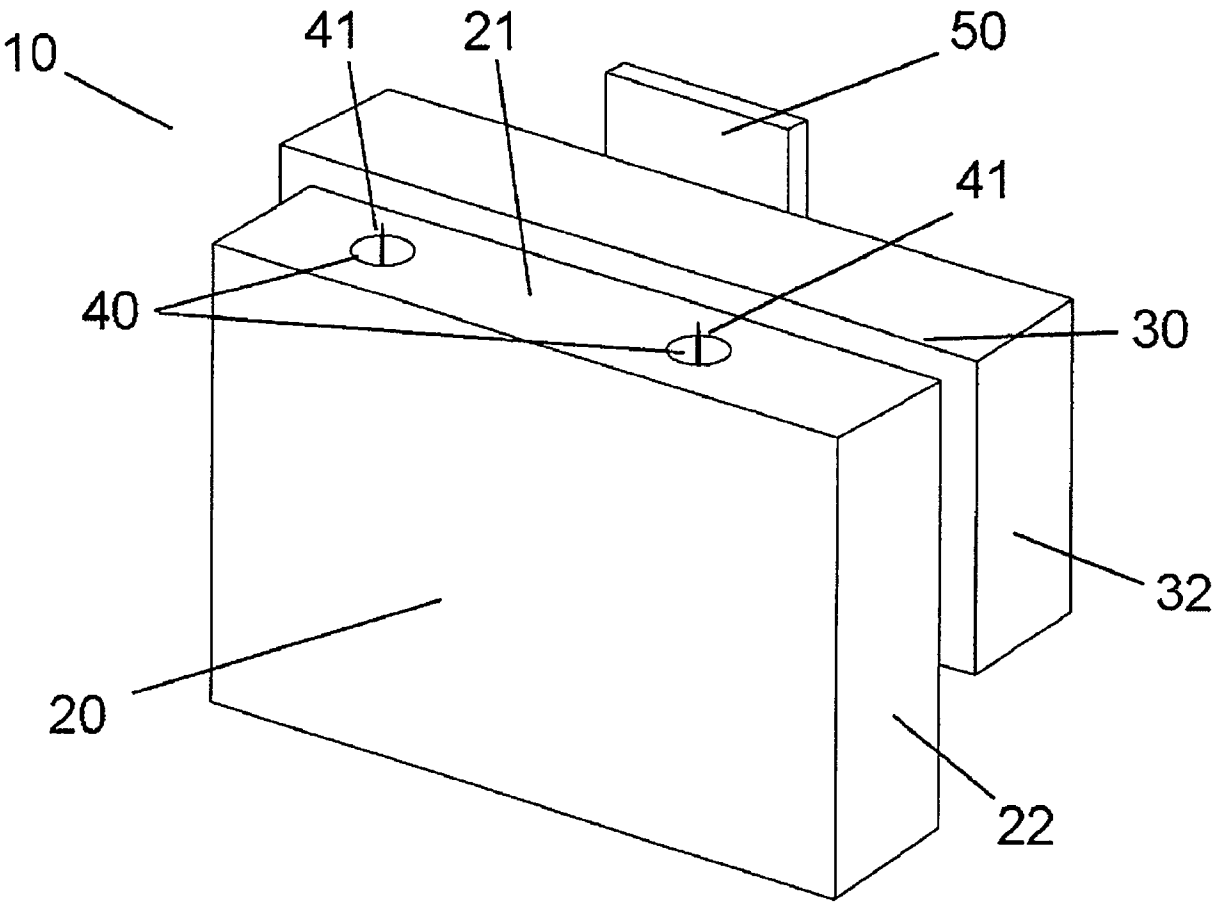
FIG. 1, is a depiction of a trim installation tool according to an embodiment of the present invention.
Figure 2:
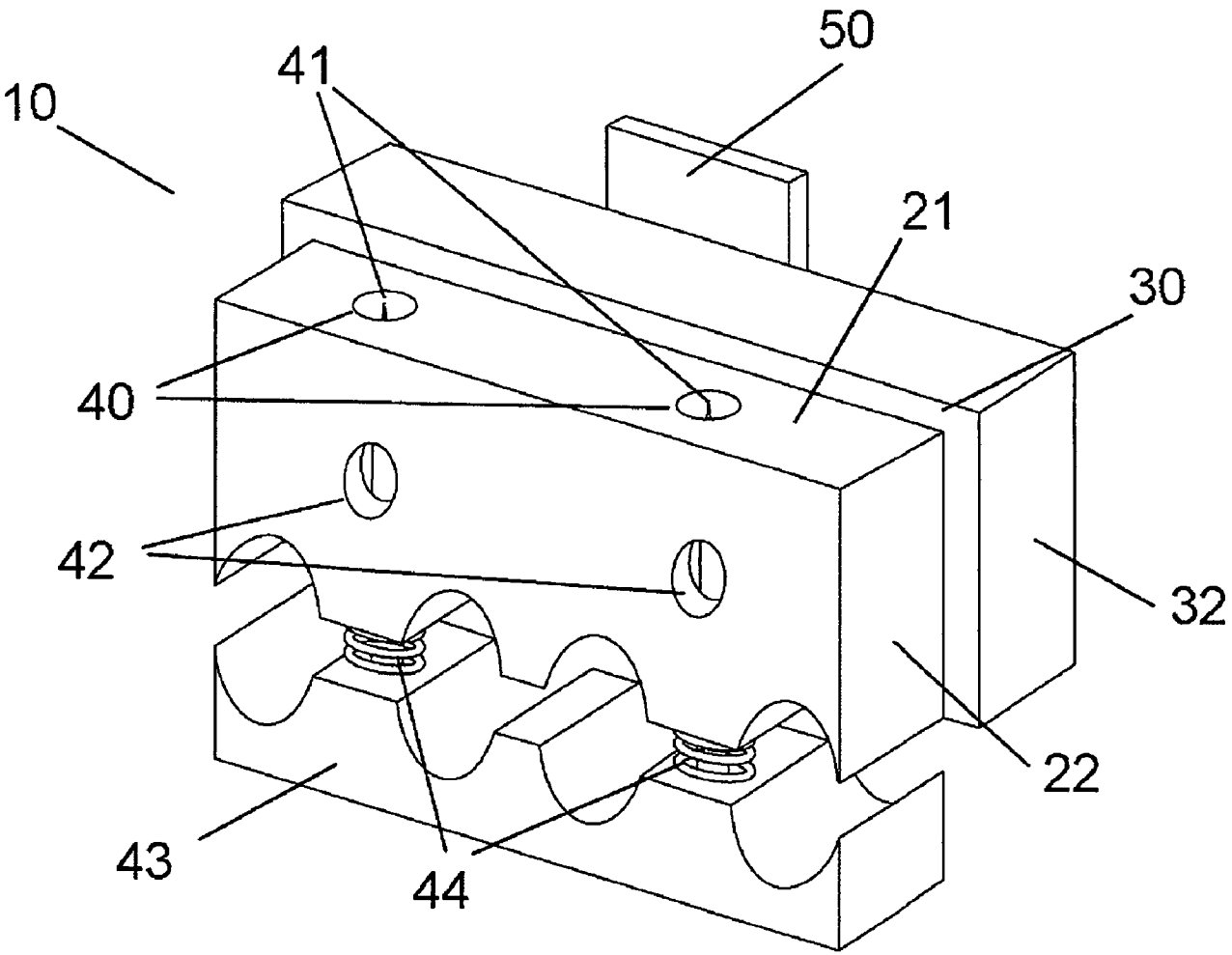
FIG. 2, is a depiction of a trim installation tool with an attachment mechanism according to an embodiment of the present invention.

The trim installation tool 10 generally comprises a support portion 20 with one or more reveal locating ledges 30 extending outwardly from the support portion 20 as shown in FIG. 1. The trim installation tool also includes an attachment portion 40 for securely attaching the trim installation tool 10 to the door jamb or window jamb around which the trim is being installed. The attachment portion 40 may be dynamic with respect to the trim assembly tool 10, as shown in FIG. 2. The trim installation tool 10 may additionally include one or more trim guides 50 which aid in supporting the trim as the trim rests on the a reveal locating ledge 30 of the trim installation tool 10.

Figure 3:
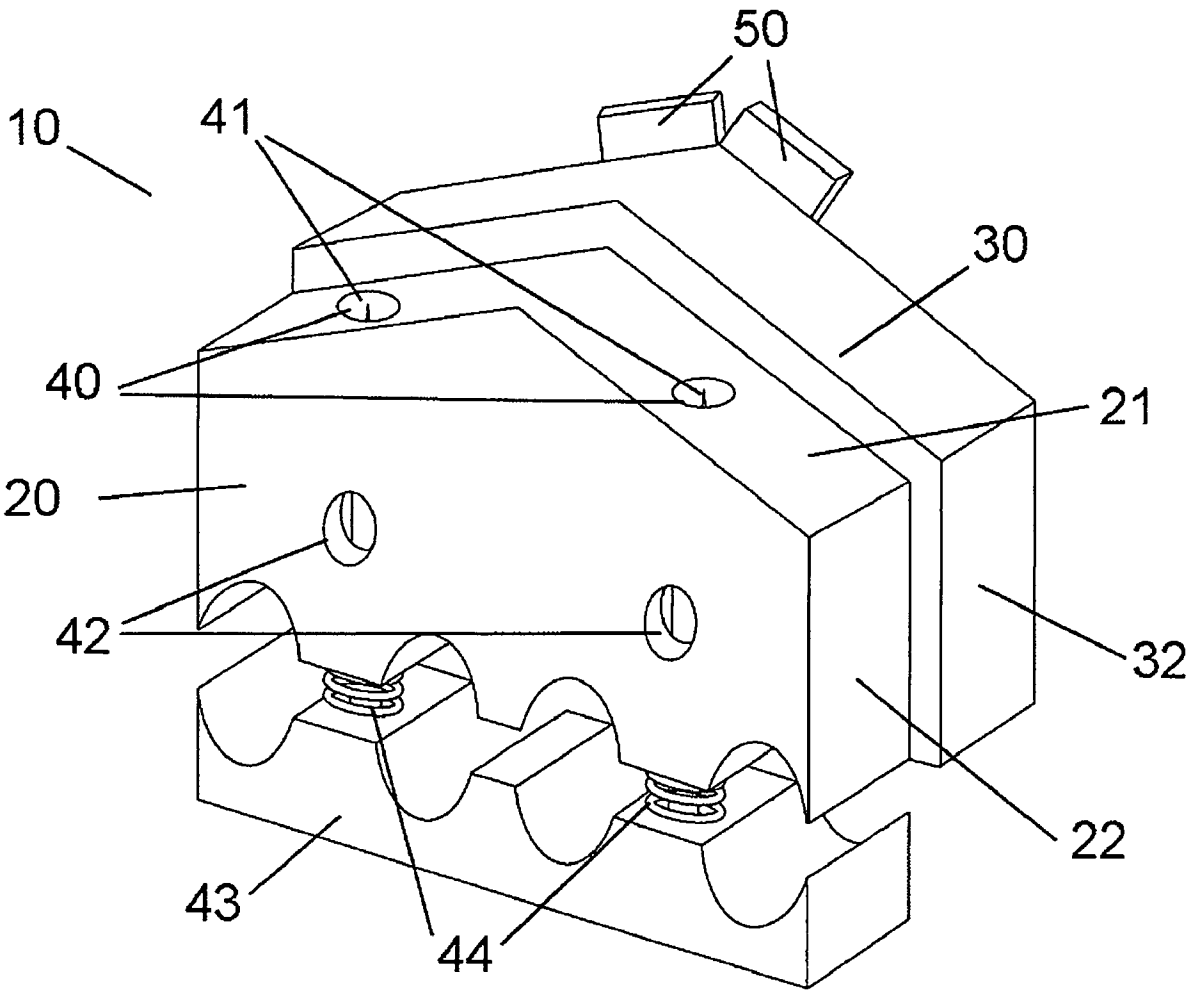
FIG. 3, is a depiction of a trim installation tool having an angled upper surface according to an embodiment of the present invention.
Figure 4:
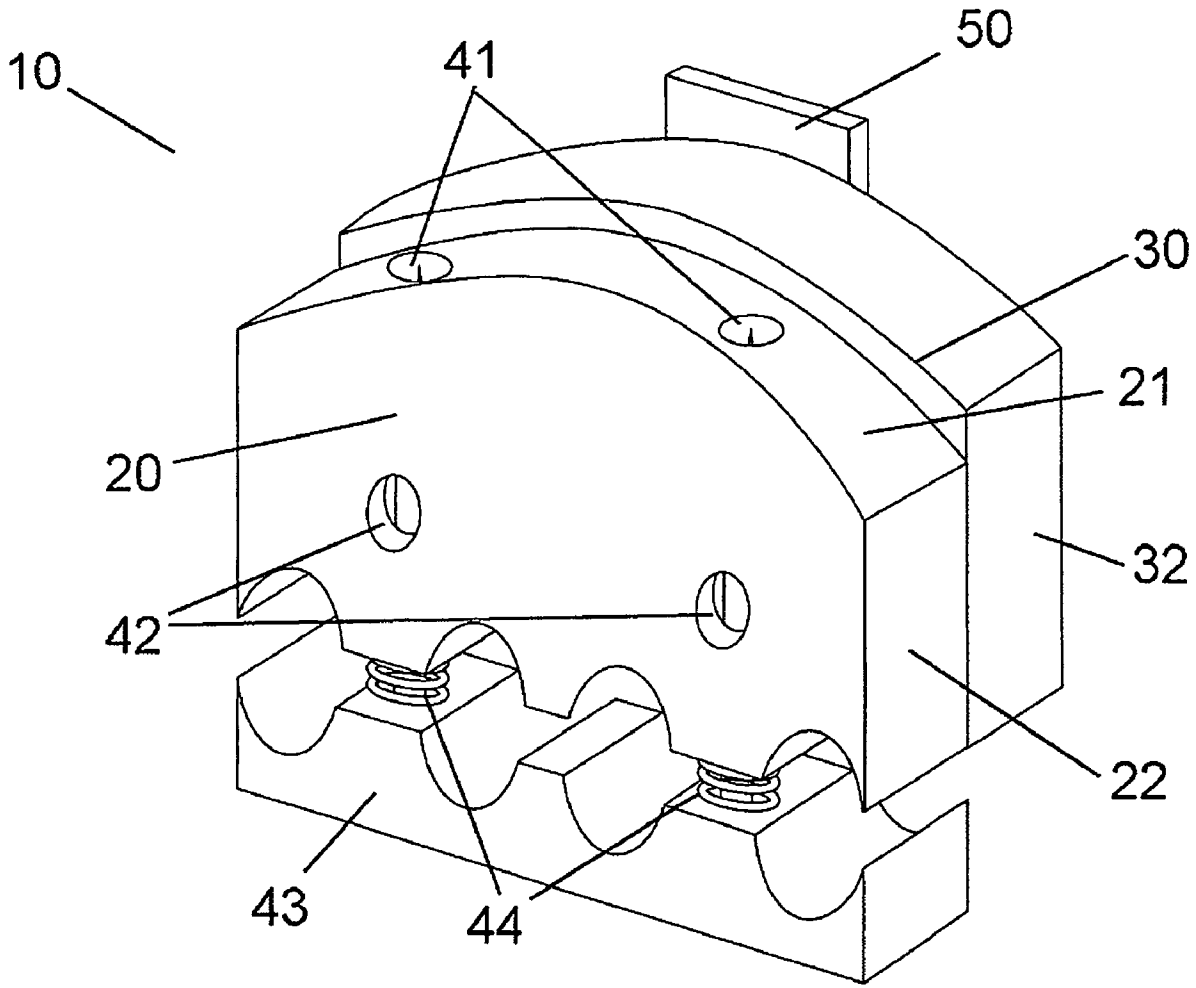
FIG. 4, is a depiction of a trim installation tool having an arcuate upper surface according to an embodiment of the present invention.

The support portion 20 of the trim installation tool may be any type block or structure that has a shape allowing the support portion 20 to be disposed against the surface of a door jamb or window jamb. During typical use, the upper surface 21 and/or one or more side surfaces 22 of the support portion 20 is in contact with the door or window jamb. The upper surface 21 of the support portion 20 may be flat or divided into two or more sections which conform to the inner dimension of a polygonal jamb. For instance, the upper surface 21 of the support portion 20 may comprise two sections which come together to form an obtuse angle as shown in FIG. 3. The upper surface 21 of the support portion 20 may also be arcuate to conform to arched jambs as shown in FIG. 4. One or more of the side surfaces 22 may be disposed at a 90 degree angle, an acute angle, or an obtuse angle with respect to the upper surface 21 of the support portion 20.

Figure 5:
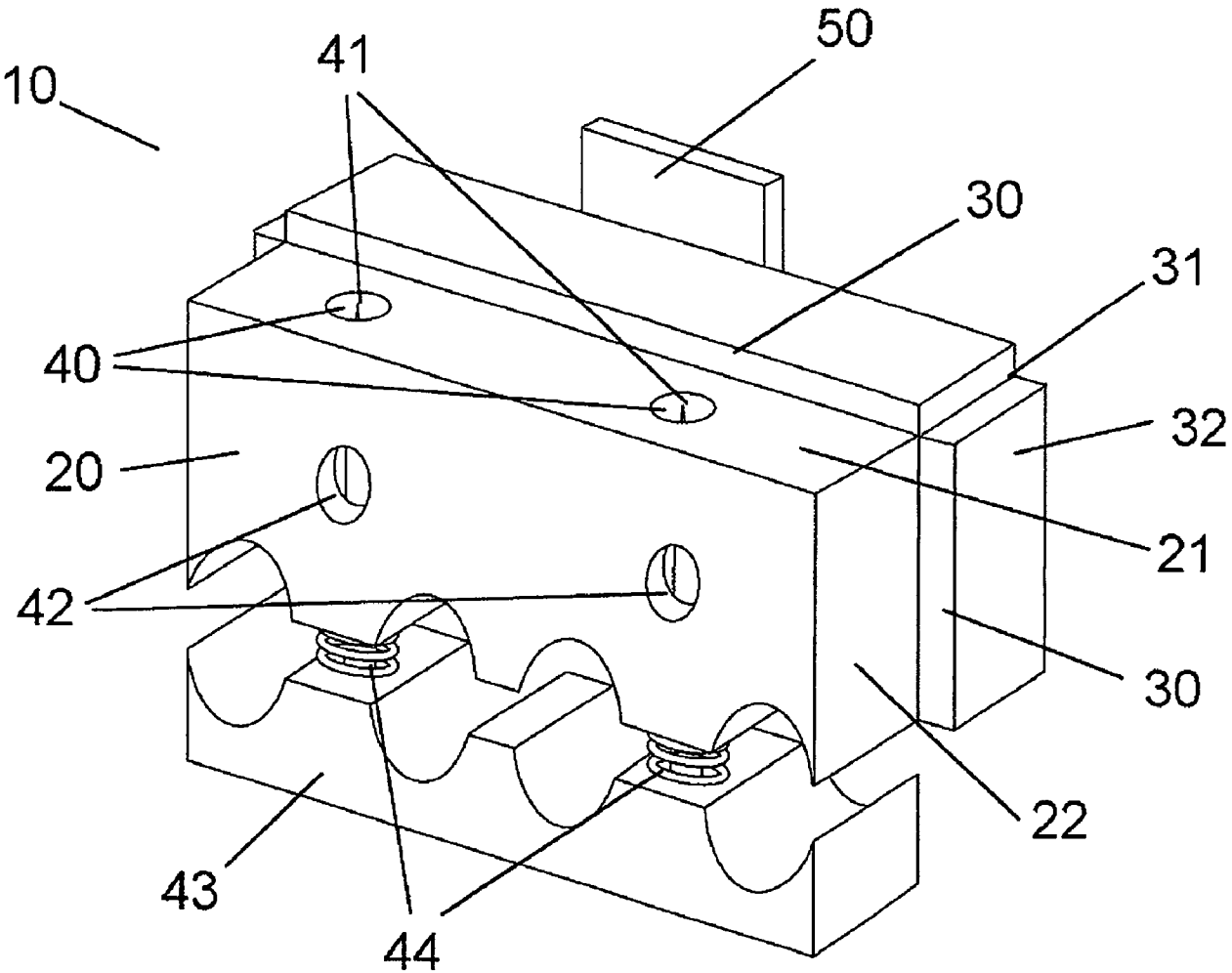
FIG. 5 is a depiction of a trim installation tool which accommodates corner blocks according to an embodiment of the present invention.

The one or more reveal locating ledges 30 may be disposed adjacent to the upper surface 21 and/or side surfaces 22 of the support portion extending outwardly from the support portion 20. Alternatively, one or more of the reveal locating ledges 30 may be disposed on the upper surface 21 or side surfaces 22 of the support portion 20 extending outwardly from the support portion 20. The one or more reveal locating ledges 30 may be one continuous reveal locating ledge which extends outwardly from the upper surface 21 and/or side surfaces 22 of the support portion as shown in FIGS. 1 and 2. Alternatively, the one or more reveal locating ledges 30 may be disposed along at least a portion of the upper surface 21 and/or the side surfaces 22 of the support portion 20. In the case of a continuous reveal locating ledge, the reveal locating ledge may have a notch 31 removed from a corner of the reveal locating ledge which allows the trim installation tool to be used when decorative blocks are present in the corners of a jamb. Examples of blocks surrounding a window or door jamb are rosettes. This embodiment of the present invention is depicted in FIG. 5.

Figure 6:
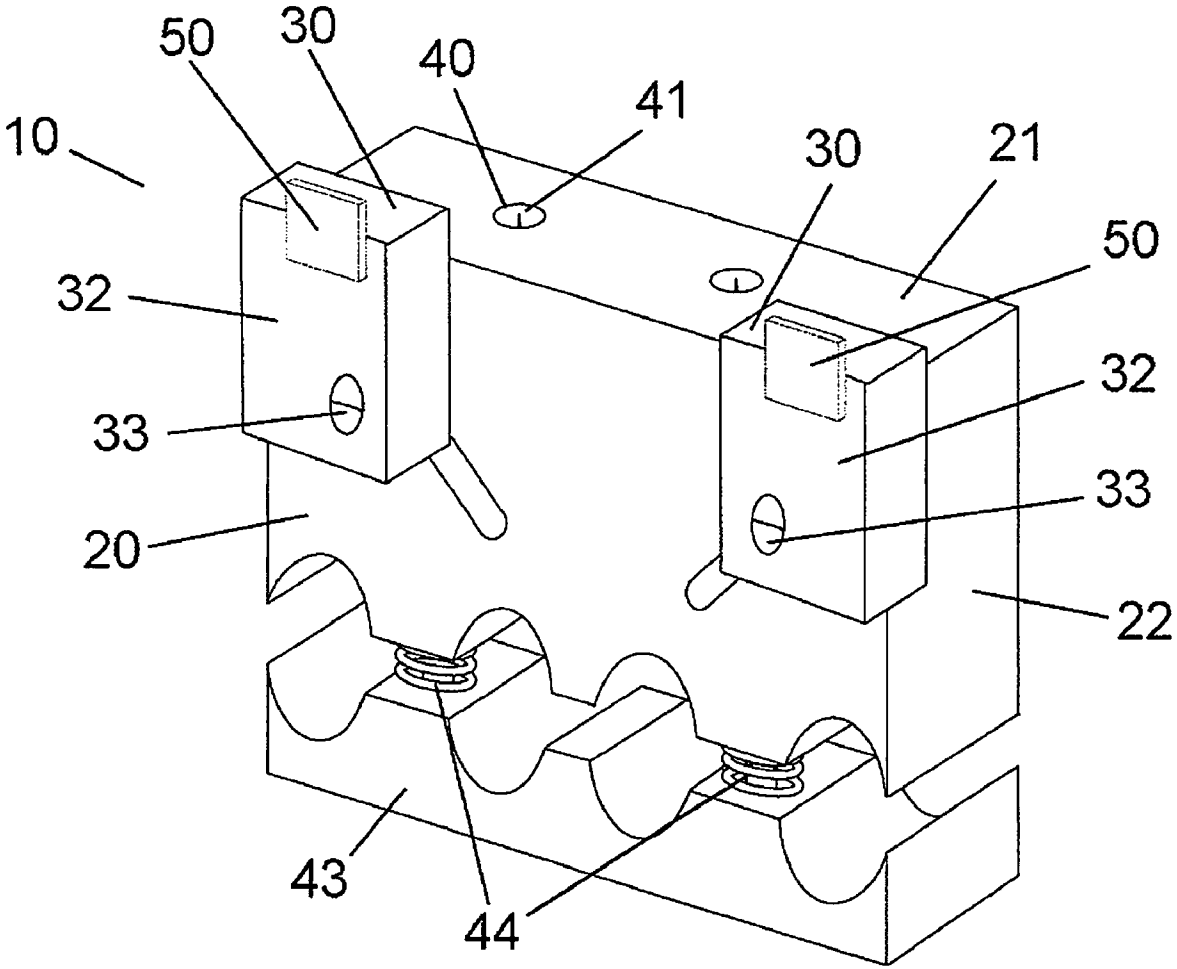
FIG. 6, having two adjustable reveal locating members according to an embodiment of the present invention.

The one or more reveal locating ledges 30 may be formed from one or more reveal locating members 32 which extend vertically with respect to the upper surface 21 and/or horizontally with respect to the side surfaces 22 of the support portion. An example of a reveal locating member 32 is a rectangular block as shown in FIGS. 1 and 2. The one or more reveal locating members 32 may also be adjustable with respect to the support portion 20. The one or more reveal locating members 32 may be a single member which provides for vertical, horizontal or diagonal adjustment with respect to the support portion 20. The reveal locating members 32 may also comprise two or more members which are adjustable in a vertical, horizontal, or diagonal manner with respect to the support portion. The two or more reveal locating members 32 may move independent from one another or they may be in communication with one another such that the reveal locating members move in unison with one another thereby providing for a consistently marked reveal around all edges of the trim installation tool 10. In an alternative embodiment of the present invention as shown in FIG. 6, the one or more reveal locating members 32 comprise two adjustable members which move diagonally with respect to the support portion 20. The diagonal movement of the reveal locating members 32 provides for a consistent reveal to be measured and marked along both the upper surface 21 and side surfaces 22 of the support portion 20. The adjustable reveal locating members may be locked into place with a set screw 33 as shown in FIG. 6. The adjustable reveal locating members may be locked into place with any type locking mechanism known in the art. An additional example of a locking mechanism is a locking groove which locks a moving member in place in increments as the moving member travels along the groove. Such grooves are common among other tools such as utility knives.

The attachment portion 40 may comprise one or more pins 41 which extend outwardly from the upper surface 21 of the support portion 20. During use, the one or more pins 41 are pressed into the door or window jamb and securely hold the trim installation tool in place. To remove the trim installation tool from the door or window jamb the trim installation tool is pulled from the jamb thereby removing the one or more pins 41 from the jamb. The diameter of the one or more pins 41 may vary, however, it is preferred that the diameter of the one or more pins 41 be minimized to prevent damage to the door or window jamb. Preferably, the one or more pins 41 are removable from the support portion 20, which allows the one or more pins to be changed if broken or damaged. The support portion 20 may include one or more access holes 42 which provide access to the one or more pins 42 within the support portion 20 such that the one or more pins 41 may be disengaged from the support portion 20 for replacement.

The one or more pins 41 may be retractable into the support portion 20 as shown in FIGS. 2-9. The one or more pins 41 may be extended from the support portion 20 and retracted into the support portion 20 via a handle 43 disposed at the bottom of the support portion 20. Each of the retractable pins may be in mechanical communication with the handle 43 and at least partially housed within the support portion 20 when in the retracted position. Preferably, the retractable pins are fully housed by the support portion 20 when in the retracted position to prevent inadvertent contact with the retractable pins. When the handle 43 of the trim installation tool is actuated in the upward direction with respect to the support portion 20, the retractable pins protrude from the support portion 20 into the engaging position. To retract the pins from the engaging position back into the retracted position, the handle 43 is actuated in downward direction with respect to the support portion 20. To maintain the pins in the retracted position and to aid in retracting the pins when engaged with a door or window jamb, the handle may be biased in the downward direction by one or more biasing members 44. The one or more biasing members 44 may be selected from springs, spring clips, or any other type biasing members generally know in the art.

Each of the one or more trim support guides 50 generally comprises a planar member extending outwardly from the one or more reveal locating ledges. The one or more trim support guides 50 support the trim during installation as the trim rests on one or more of the reveal locating ledges 30. The shape and size of the one or more trim support guides 50 may vary provided the one or more trim support guides 50 are able to prevent the trim from sliding off of the one or more reveal locating ledges 30. One or more of the trim support guides 50 may be disposed on or adjacent to one or more of the reveal locating ledges of the trim installation tool. Preferably, the side edges of the one or more trim support guides are disposed at a 90 degree angle with respect to the upper surface of the one or more reveal locating ledges. This allows the one or more trim support guides to be used to support the distal portion of a tape measure opposite the base as measurements are being taken along the door or window jamb.

Figure 7:
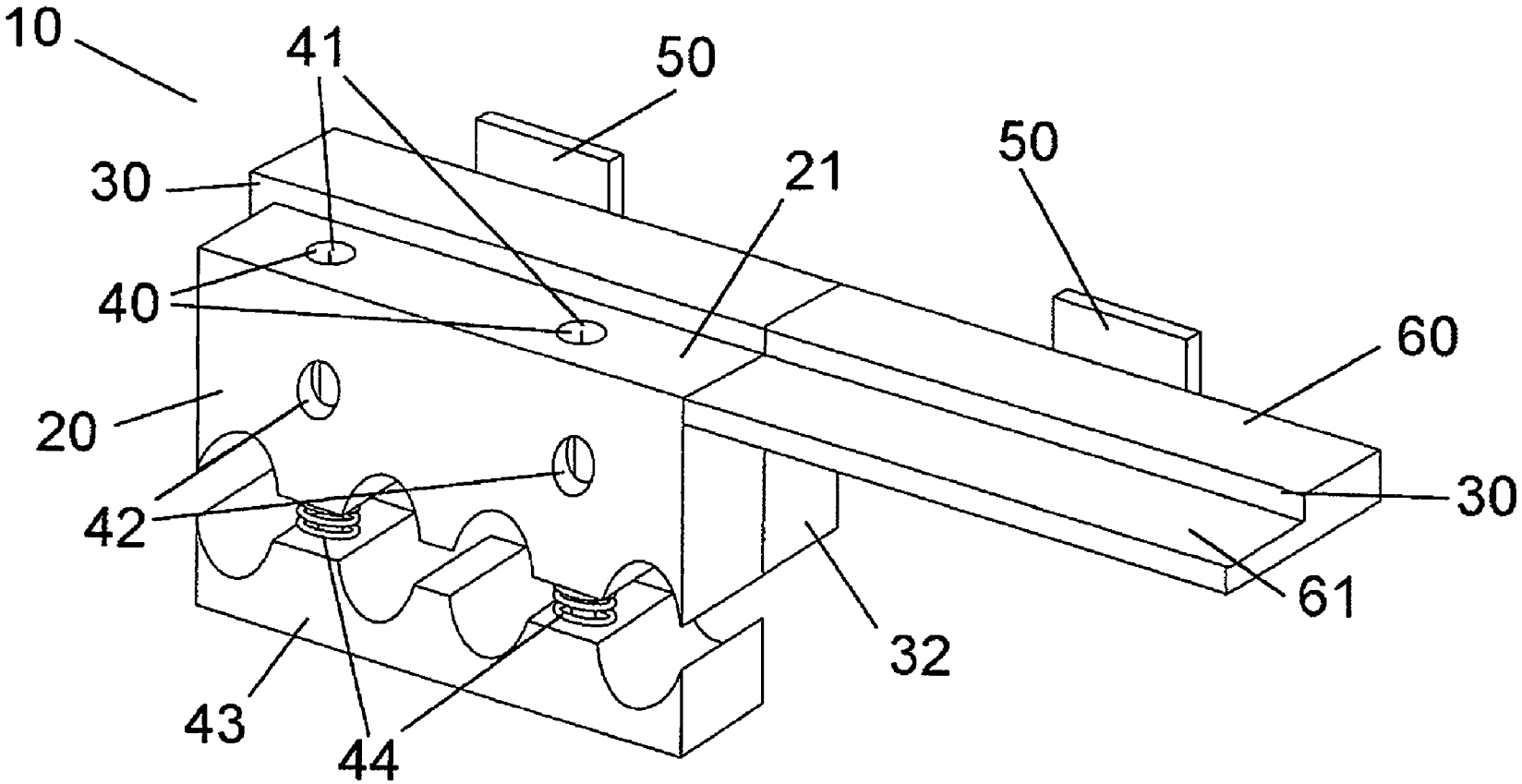
FIG. 7, is a depiction of a trim installation tool having an extension member according to an embodiment of the present invention.

The trim installation tool 10 may further include one or more extension members 60 which extend outwardly in a horizontal fashion from the upper surface 21 of the support portion 20 as shown in FIG. 7. The one or more extension members 60 act to extend the upper surface 21 of the support portion 20 to cover additional area along the jamb of a window or door. Similar to the upper surface 21 of the support portion 20, the one or more extension members 60 may have one or more reveal locating ledges 30. The reveal locating ledges 30 may be disposed on or adjacent to the upper surface 61 of the extension members 60. The one or more extension members 60 may be detachably connected to the support portion 20. The one or more extension members 60 may also be flexible so as to conform to the arched surface of a door or window jamb.

Figure 8:
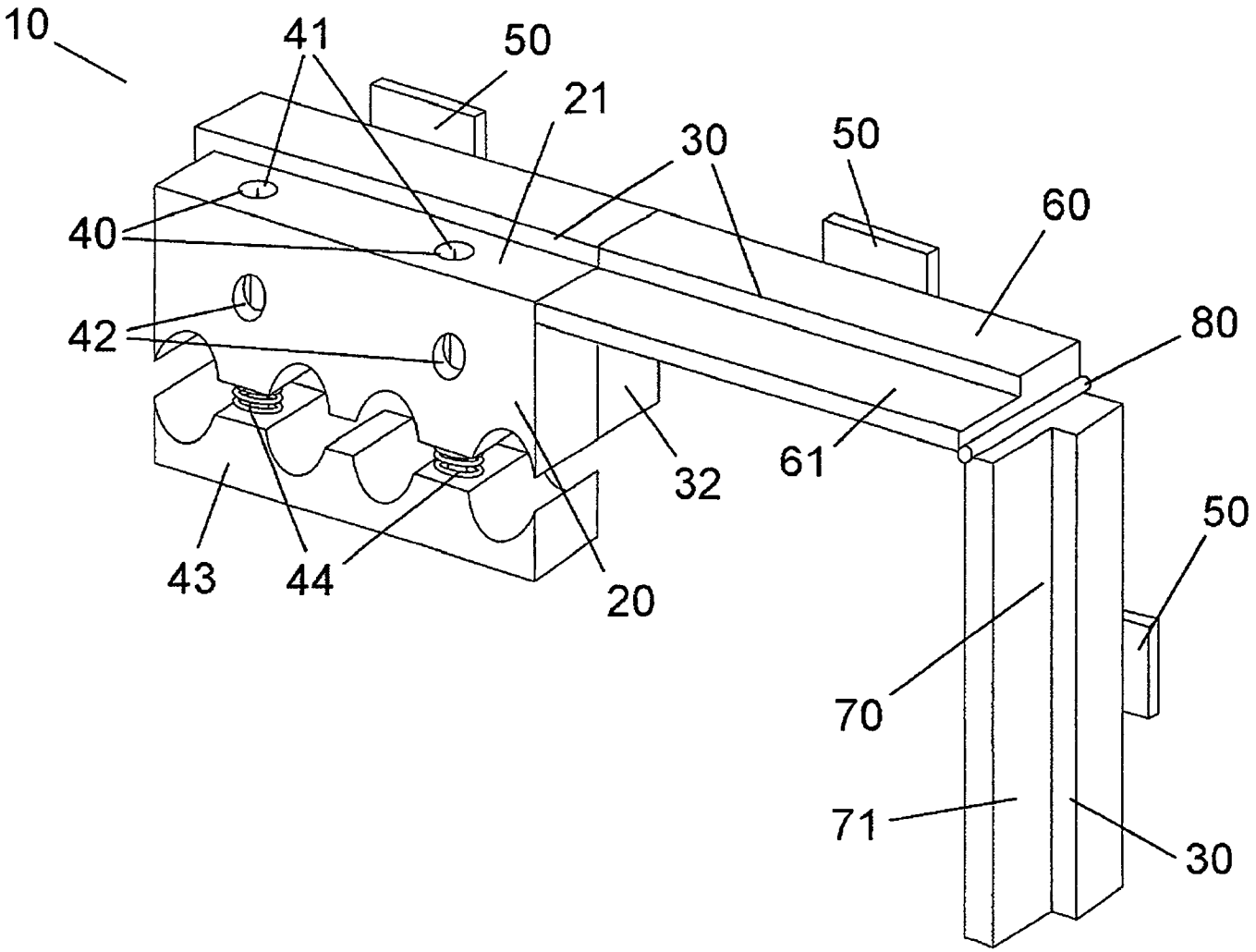
FIG. 8, is a depiction of a trim installation tool having an second extension member hingedly attached to a first extension member according to an embodiment of the present invention.
Figure 9:
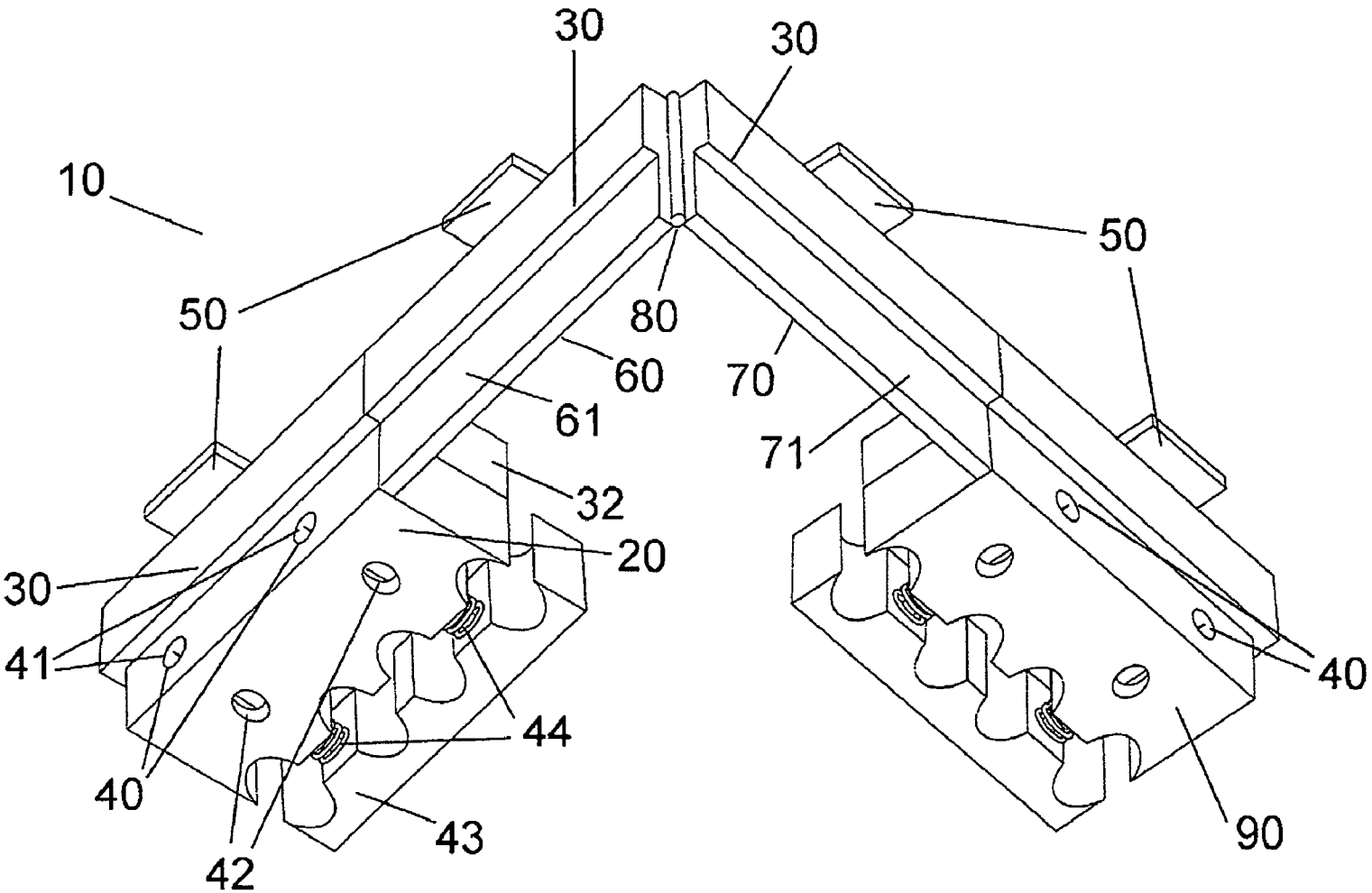
FIG. 9, is a depiction of a trim installation tool having an second extension member with a second support portion hingedly attached to a first extension member according to an embodiment of the present invention.

A second extension member 70 may be hingedly connected to the first extension member 60 at the distal end of the first extension member 60 opposite the support portion 20 as shown in FIG. 8. This provides the trim installation tool 10 with adjustability to conform to door or window jambs that have various polygonal shapes such as triangles, rectangles, pentagons, octagons, etc. Similar to the first extension member 60, the second extension member 70 may also have one have one or more reveal locating ledges 30 disposed on the upper surface 71 of the of the second extension member 70. The hinge 80 may be a locking hinge which locks the second extension member 70 in a set position with respect to the first extension member 60. The locking hinge allows the user to move the second extension member 70 into a desired position with respect to the first extension member 60 and lock the second extension member into place. In an alternative embodiment as shown in FIG. 9, the second extension member 70 may be attached to a second support portion 90 having an attachment portion 40 as previously described.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

The invention claimed is:

1. A trim installation tool comprising:

a support portion having an upper surface and one or more side surfaces;

one or more reveal locating ledges disposed proximate to and extending outwardly from said support portion; and one or more attachment pins extending from said upper surface of said support portion, wherein said one or more attachment pins retract into said support portion.

2. The trim installation tool according to claim 1, wherein said upper surface comprises two sections which together form an obtuse angle.

3. The trim installation tool according to claim 1, wherein said upper surface has an arcuate shape.

4. The trim installation tool according to claim 1, wherein said one or more reveal locating ledges form 90 degree notches at one or more edges of said upper surface of said support portion.

5. The trim installation tool according to claim 1, wherein at least one of said one or more side surfaces is disposed at a 90 degree angle, an acute angle, or an obtuse angle with respect to said upper surface of said support portion.

6. The trim installation tool according to claim 1, wherein at least one of said reveal locating edges is disposed proximate to and extends outwardly from said upper surface of said support portion.

7. The trim installation tool according to claim 1, wherein at least one of said reveal locating edges is disposed proximate to and extends outwardly from at least one of said one or more side surfaces of said support portion.

8. The trim installation tool according to claim 1, wherein said one or more reveal locating ledges is formed from one or more reveal locating members.

9. The trim installation tool according to claim 8, wherein said one or more reveal locating members comprise a block disposed adjacent to said support portion.

10. The trim installation tool according to claim 8, wherein said one or more reveal locating members are adjustable vertically, horizontally, or diagonally with respect to said support portion.

11. The trim installation tool according to claim 1, further comprising a handle in mechanical communication with said one or more attachment pins, said handle causing said one or more attachment pins to extend from and retract into said support portion.

12. The trim installation tool according to claim 11, wherein said handle is biased in a downward direction from said support portion by a biasing member.

13. The trim installation tool according to claim 1, further comprising one or more trim guides disposed adjacent to and extending outwardly from said one or more reveal locating ledges.

14. The trim installation tool according to claim 1, further comprising a first extension member, said first extension member extending outwardly from said upper surface of said support portion, said first extension member having one or more reveal locating ledges disposed proximate to and extending outwardly from the upper surface of said first extension member.

15. The trim installation tool according to claim 14, wherein said first extension member is detachable connected to said support portion.

16. The trim installation tool according to claim 14, wherein said first extension member is flexible.

17. The trim installation tool according to claim 14, further comprising a second extension member hingedly connected to said first extension member, said second extension member having one or more reveal locating ledges disposed proximate to and extending outwardly from the upper surface of said extension member.

18. The trim installation tool according to claim 17, hinged connection between said first extension member and said second extension member is formed by a locking hinge.

19. The trim installation tool according to claim 17, further comprising a second support member attached to said second extension member, said second support member having an upper surface, one or more side surfaces, and one or more attachment pins extending from said upper surface of said second support portion.

* * * * *